US006311413B1

(12) United States Patent
Chern et al.

(10) Patent No.: US 6,311,413 B1
(45) Date of Patent: Nov. 6, 2001

(54) REPLACEABLE ELASTIC AIR CUSHION SHOE STRUCTURE

(76) Inventors: Ming-Dong Chern; Cheng-Ju Ho, both of 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/659,425

(22) Filed: Sep. 6, 2000

(51) Int. Cl.[7] ..... A43C 13/00; A43B 3/24; A43B 23/00; A43B 23/20

(52) U.S. Cl. ..... 36/15; 36/100; 36/101; 36/137; 36/23

(58) Field of Search ..... 36/100, 101, 15, 36/137, 117.3, 117.4, 3 R, 3 B, 23, 24, 36 R, 36 B, 36 C, 42

(56) References Cited

U.S. PATENT DOCUMENTS 1,142,662 * 6/1915 Blaney ..... 36/36 R
2,528,951 * 11/1950 Epsztejn ..... 36/15
3,902,259 * 9/1975 Cracco ..... 36/11.5
3,906,646 * 9/1975 Milotic ..... 36/100
4,606,139 * 8/1986 Silver ..... 36/3 B
4,974,344 * 12/1990 Ching ..... 36/101
5,317,822 * 6/1994 Johnson ..... 36/101

* cited by examiner

*Primary Examiner*—Paul T. Sewell
*Assistant Examiner*—Anthony Stashick

(57) ABSTRACT

A replaceable elastic air cushion shoe structure includes a sole, and a vamp. The sole has a top provided with a plurality of oblique conical locking grooves and having a periphery provided with a plurality of waterproof ribs. The sole has a periphery defining a plurality of locking recesses each provided with a catch piece. The vamp has a bottom provided with a plurality of oblique conical locking blocks each locked in the locking groove of the sole. The bottom of the vamp defines a plurality of waterproof slots for receiving the waterproof ribs of the sole therein so that the vamp is integrally formed with the sole. A plurality of U-shaped snapping pieces are each secured in the bottom of the vamp and each have two sides each provided with a hook. A plurality of snapping knobs are each detachably secured on the snapping piece and each include a press button secured in the locking recess and locked by the catch piece of the sole, and a snap pivotally mounted on the press button and snapped on the hook of the snapping piece.

4 Claims, 8 Drawing Sheets

REPLACEABLE ELASTIC AIR CUSHION SHOE STRUCTURE

BACKGROUND OF THE INVENTION

1. Field of the Invention

The present invention relates to a replaceable elastic air cushion shoe structure.

2. Description of the Related Art

A conventional shoe structure in accordance with the prior art comprises a vamp and a sole integrally formed with each other so that the sole and the vamp are fixed and cannot be replaced and removed from each other. A conventional air cushion shoe structure has a constant elastic coefficient and cannot be adjusted so as to fit users of different weights, thereby limiting the versatility of the shoe structure.

SUMMARY OF THE INVENTION

In accordance with one aspect of the present invention, there is provided a replaceable elastic air cushion shoe structure comprising:

- a sole having a top provided with a plurality of oblique conical locking grooves, the top of the sole having a periphery provided with a plurality of waterproof ribs, the sole having a periphery defining a plurality of locking recesses each provided with a catch piece;
- a vamp having a bottom provided with a plurality of oblique conical locking blocks each locked in the locking groove of the sole, the bottom of the vamp defining a plurality of waterproof slots for receiving the waterproof ribs of the sole therein so that the vamp is integrally formed with the sole;
- a plurality of substantially U-shaped snapping pieces each integrally secured in the bottom of the vamp and each having two sides each provided with a hook; and
- a plurality of snapping knobs each detachably secured on the snapping piece and each including a press button secured in the locking recess and locked by the catch piece of the sole, and a snap pivotally mounted on the press button and snapped on the hook of the snapping piece.

The sole defines a hollow chamber having a side wall defining an opening having a periphery defining a plurality of snap holes. A cover is removably mounted in the opening and is provided with a plurality of snap lugs each detachably secured in the snap hole of the opening. A magic strap is provided on the cover and the periphery of the opening. A substantially U-shaped elastic steel piece is received in the hollow chamber and has two side plates each defining a large retaining hole, a small retaining hole, and a connecting hole connecting between the large retaining hole and the small retaining hole. A plurality of elastic members are each mounted in the elastic steel piece and each include an upper cap and a lower cap, wherein, the top of the upper cap and the bottom of the lower cap are each provided with a joint and a connecting post. The joint is fitted into the large retaining hole and then shifted into the small retaining hole. The upper cap and the lower cap are each provided with a hollow positioning post, and a spring is mounted between the upper cap and the lower cap and has two ends each secured on the positioning post.

A battery base is secured in the hollow chamber of the sole, and a battery is secured in the battery base. A light emitting member is electrically connected to the battery and has a positive pole wire and a negative pole wire respectively extending through the hollow positioning post of the upper cap and the lower cap so that the light emitting member lights when the positive pole wire and the negative pole wire are moved by the positioning post to electrically connect with each other.

Further benefits and advantages of the present invention will become apparent after a careful reading of the detailed description with appropriate reference to the accompanying drawings.

DETAILED DESCRIPTION OF THE INVENTION

Figure 1:
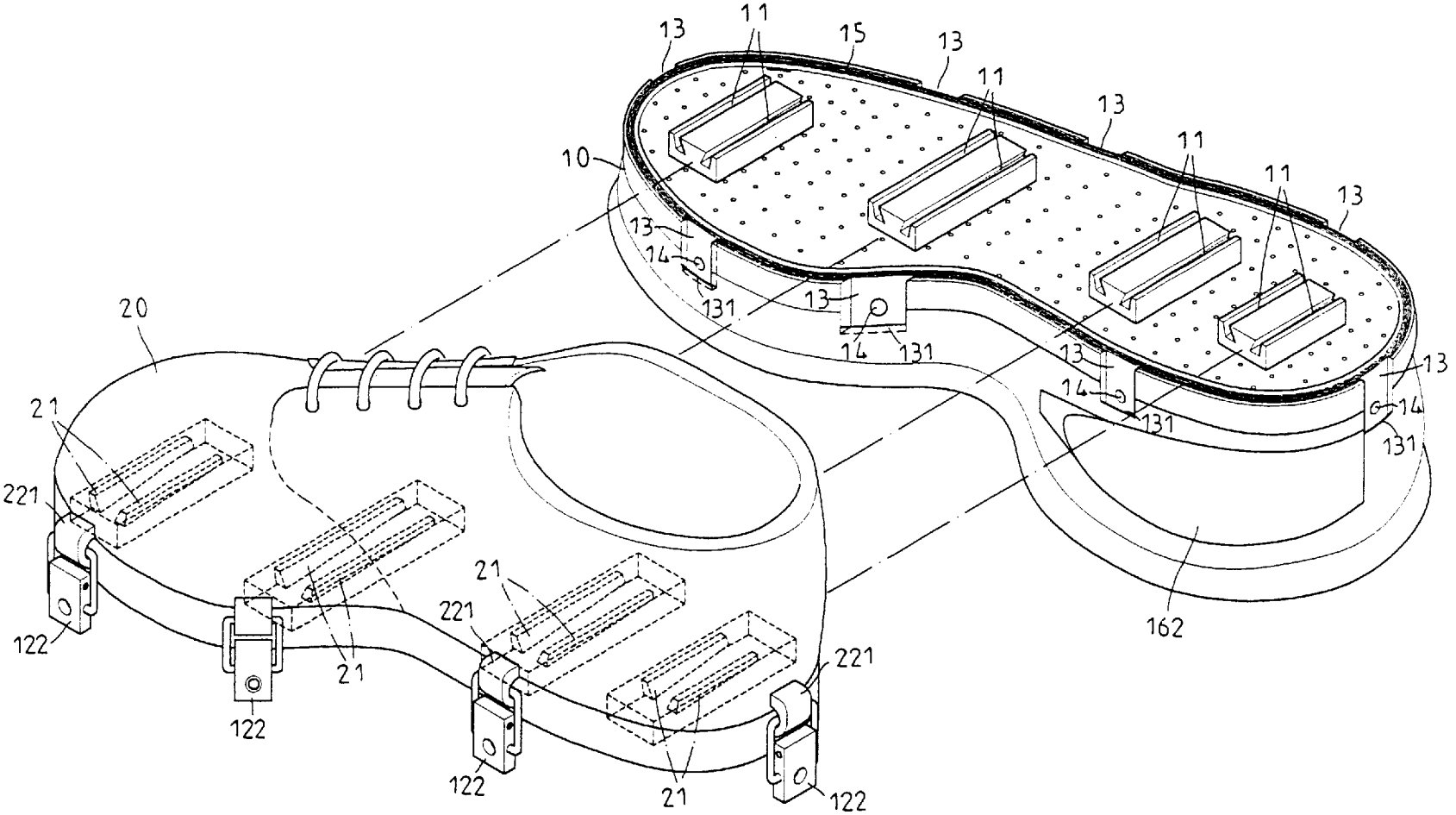
FIG. 1 is a partially exploded view of a replaceable elastic air cushion shoe structure in accordance with the present invention.
Figure 1A:
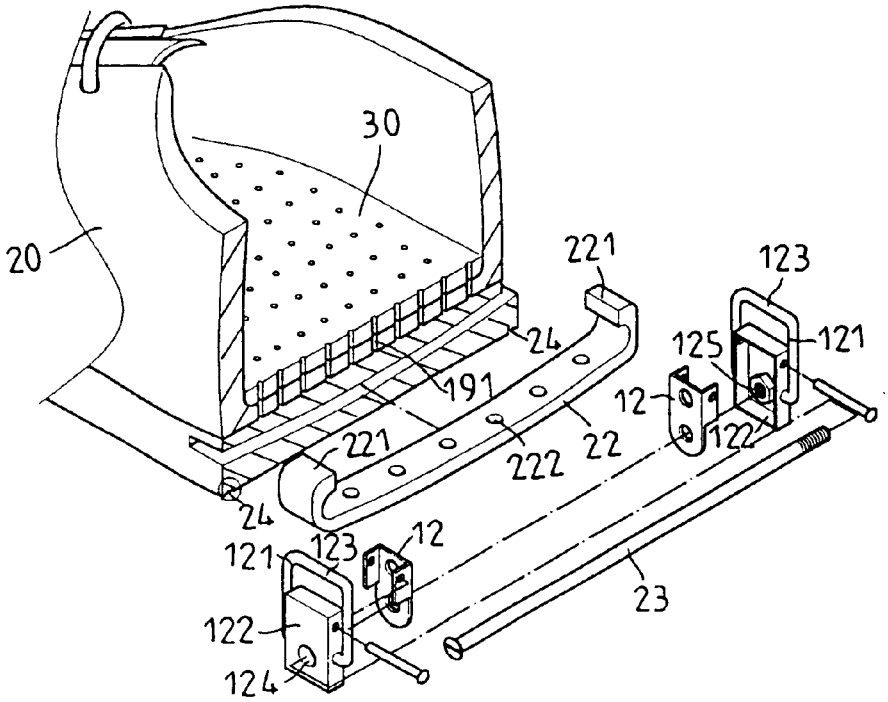
FIG. 1A is a partially cut-away exploded view of the replaceable elastic air cushion shoe structure as shown in FIG. 1.
Figure 1B:
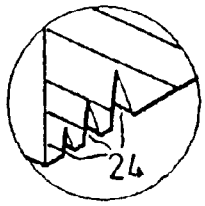
FIG. 1B is a partially cut-away cross-sectional view of a waterproof slot of the replaceable elastic air cushion shoe structure as shown in FIG. 1A.
Figure 2:
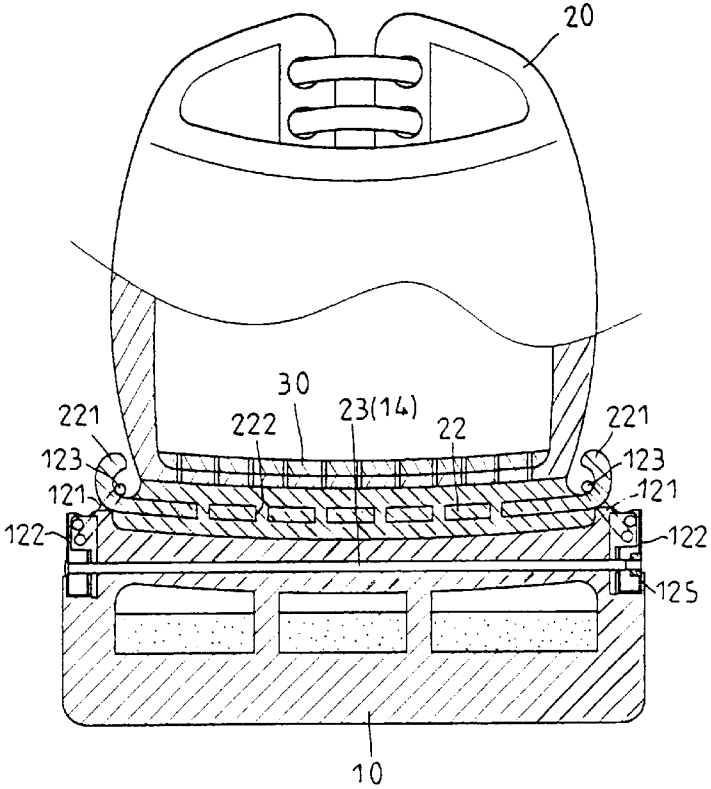
FIG. 2 is a rear plan cross-sectional assembly view of the replaceable elastic air cushion shoe structure as shown in FIG. 1.
Figure 2A:
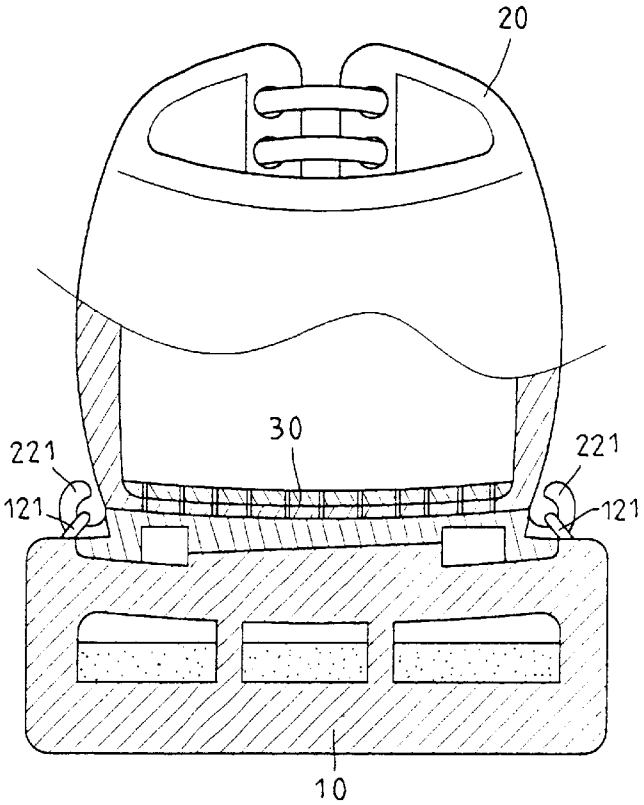
FIG. 2A is a rear plan cross-sectional assembly view of the replaceable elastic air cushion shoe structure as shown in FIG. 1.

Referring to the drawings and initially to FIGS. 1, 1A, 1B, 2, 2A, 3B and 4C, a replaceable elastic air cushion shoe structure in accordance with the present invention comprises a sole 10, a vamp, and a cushion 30 mounted in the vamp 20.

Figure 3:
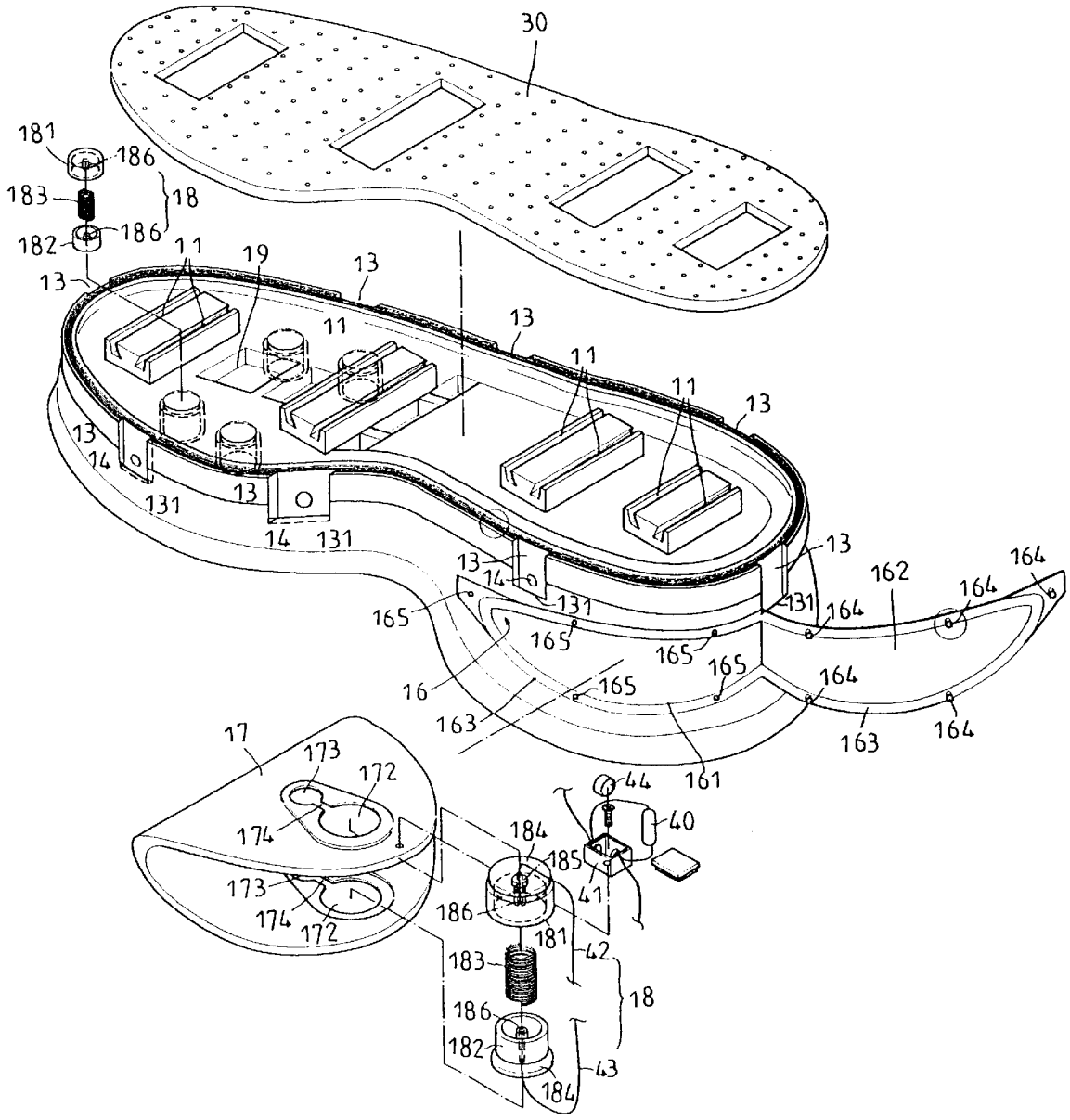
FIG. 3 is an exploded view of the replaceable elastic air cushion shoe structure as shown in FIG. 1.
Figure 3A:
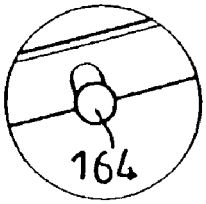
FIG. 3A is a partially cut-away cross-sectional view of a snap lug of the replaceable elastic air cushion shoe structure as shown in FIG. 3.
Figure 3B:
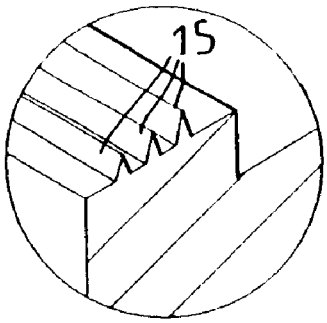
FIG. 3B is a partially cut-away cross-sectional view of a waterproof rib of the replaceable elastic air cushion shoe structure as shown in FIG. 3.

The sole 10 has a top provided with a plurality of oblique conical locking grooves 11 and having a periphery provided with a plurality of waterproof ribs 15 (see FIG. 3B). The sole 10 has a periphery defining a plurality of locking recesses 13 each provided with a catch piece 131 and defining a through hole 14.

The vamp 20 has a bottom provided with a plurality of oblique conical locking blocks 21 each locked in the locking groove 11 of the sole 10. The bottom of the vamp 20 defines a plurality of waterproof slots 24 for receiving the waterproof ribs 15 of the sole 10 therein (see FIG. 4C) so that the vamp 20 is integrally formed with the sole 10.

A plurality of substantially U-shaped snapping pieces 22 are each integrally secured in the bottom of the vamp 20 and each have two sides each provided with a hook 221. Each of the snapping pieces 22 defines a plurality of through holes 222.

A plurality of snapping knobs 12 are each detachably secured on the snapping piece 22 and each include a press button 122 secured in the locking recess 13 and locked by the catch piece 131 of the sole 10, a through hole 124 defined in press button 122, a snap 121 pivotally mounted on the press button 122 and having a hook bar 123 snapped on the hook 221 of the snapping piece 22, a hexagonal nut 125 secured on the press button 122, and a bolt 23 in turn extending through the through hole 124 of the press button 122 and through the through hole 14 of the sole 10 so that the vamp 20 and the sole 10 are securely coupled with each other.

Figure 4:
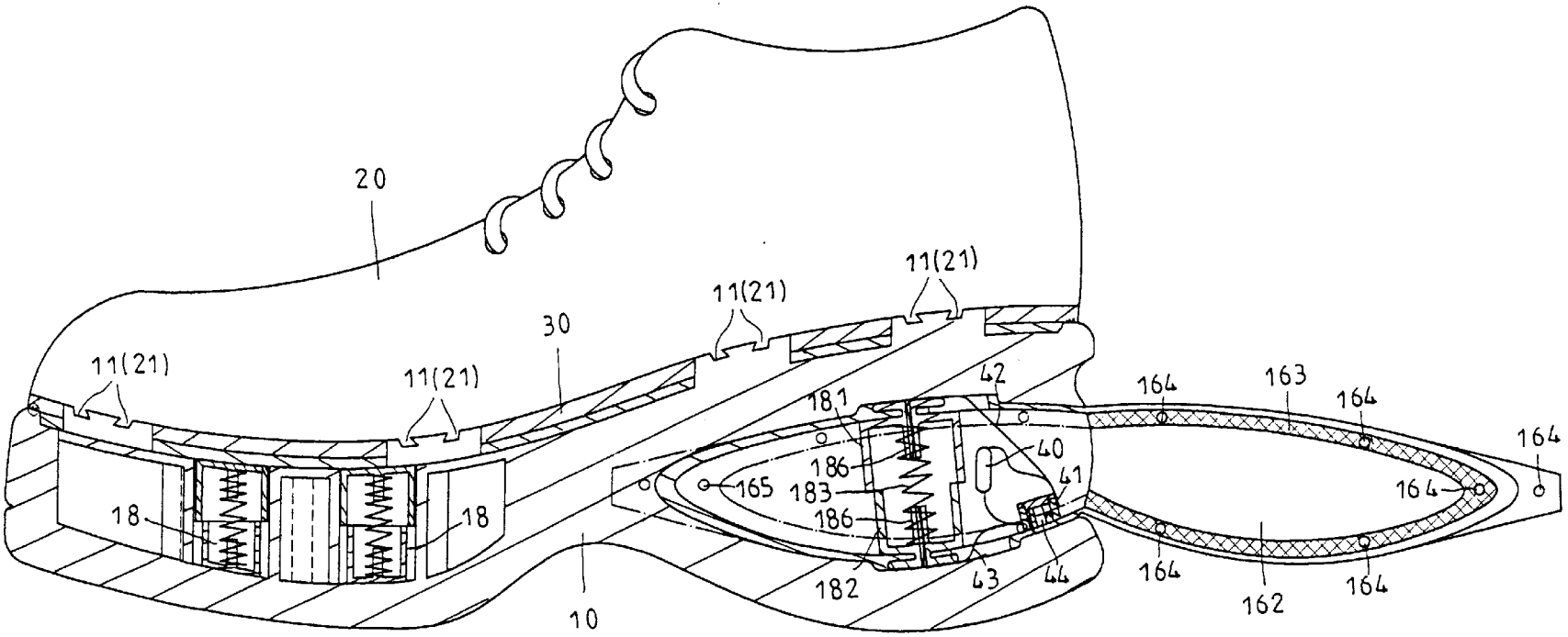
FIG. 4 is a side plan cross-sectional assembly view of the replaceable elastic air cushion shoe structure as shown in FIG. 3.
Figure 4A:
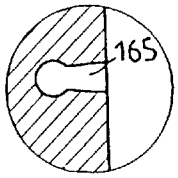
FIG. 4A is a partially cut-away cross-sectional view of a snap hole of the replaceable elastic air cushion shoe structure as shown in FIG. 4.
Figure 4B:
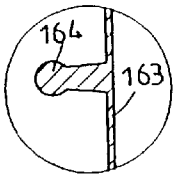
FIG. 4B is a partially cut-away cross-sectional view of a snap lug of the replaceable elastic air cushion shoe structure as shown in FIG. 4.
Figure 4C:
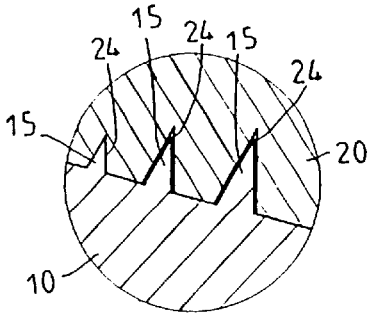
FIG. 4C is a partially cut-away cross-sectional view of the waterproof ribs engaged with the waterproof slots of the replaceable elastic air cushion shoe structure as shown in FIG. 4.

Referring to FIGS. 3, 3A, 4, 4A, 4B and 5, the sole 10 defines therein a hollow chamber 16 having a side wall defining an opening 161 having a periphery defining a plurality of snap holes 165 (see FIG. 4A). A cover 162 is removably mounted in the opening 161 and is provided with a plurality of snap lugs 164 (see FIGS. 3A and 4B) each detachably secured in the snap hole 165 of the opening 161. A magic strap 163 is provided on the cover 162 and the periphery of the opening 161.

A substantially U-shaped elastic steel piece 17 is received in the hollow chamber 16 and has two side plates each defining a large retaining hole 172, a small retaining bole 173, and a connecting hole 174 connecting between the large retaining hole 172 and the small retaining hole 173.

A plurality of elastic members 18 are each mounted in the elastic steel piece 17 and each include an upper cap 181 and a lower cap 182. The top of the upper cap 181 and the bottom of the lower cap 182 are each provided with a joint 184 and a connecting post 185. The joint 184 of the upper cap 181 and the lower cap 182 is initially fitted into the large retaining hole 172 and the connecting post 185 passes through the connecting hole 174, and is then shifted into the small retaining hole 173 so that the upper cap 181 and the lower cap 182 are respectively fixed in the small retaining hole 173 of the elastic steel piece 17. The upper cap 181 and the lower cap 182 are each provided with a hollow positioning post 186. A spring 183 is mounted between the upper cap 181 and the lower cap 182 and has two ends each secured on the positioning post 186. The spring 183 can be replaced arbitrarily so that springs of different elastic coefficients can be mounted between the upper cap 181 and the lower cap 182 so as to fit requirements of users of different statures and weights.

Figure 5:
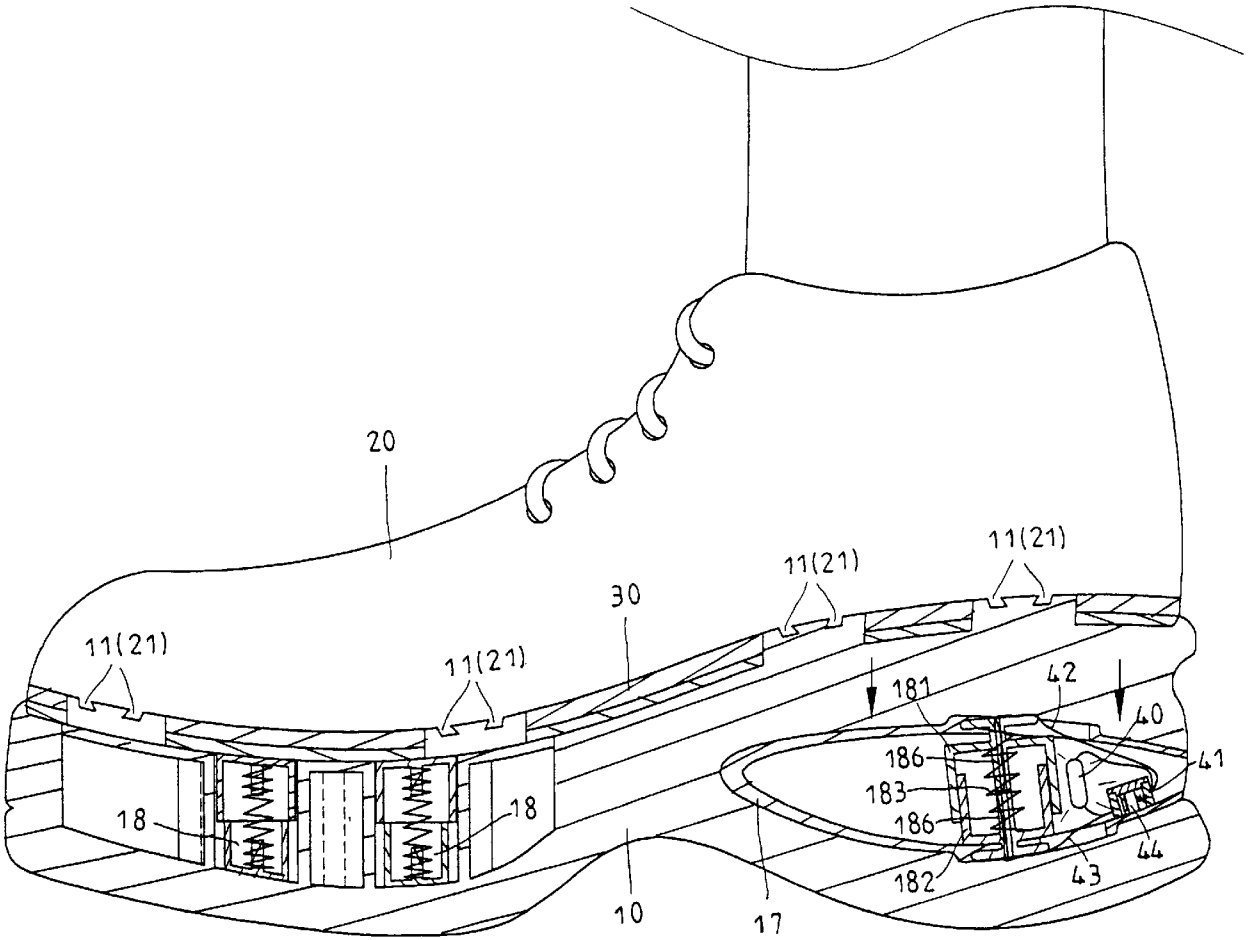
FIG. 5 is an operational view of the replaceable elastic air cushion shoe structure as shown in FIG. 4.

The replaceable elastic air cushion shoe structure further comprises a battery base 41 secured in the hollow chamber 16 of the sole 10, a battery 44 secured in the battery base 41, and a light emitting member 40 mounted in the hollow chamber 16 of the sole 10 and electrically connected to the battery 44. The light emitting member 40 has a positive pole wire 42 and a negative pole wire 43 respectively extending through the hollow positioning post 186 of the upper cap 181 and the lower cap 182 so that the light emitting member 40 lights intermittently when the positive pole wire 42 and the negative pole wire 43 are moved by the positioning post 186 to electrically connect with each other as shown in FIG. 5.

The sole 10 has a surface defining a receiving recess 19 containing fragrant powder therein, and a channel 191 (see FIG. 1A) is defined in the sole 10 and connected between the receiving recess 19 and the hollow chamber 16. In such a manner, the air contained in the hollow chamber 16 is squeezed and urged by the elastic force of the elastic member 18 through the channel 191 into the receiving recess 19 so that the fragrant powder in the receiving recess 19 of the sole 10 is introduced into the vamp 20 through the multiple-hole cushion 30, thereby enhancing the ventilating effect of the shoe structure.

It should be clear to those skilled in the art that further embodiments may be made without departing from the scope of the present invention.

What is claimed is:

1. A replaceable elastic air cushion shoe structure comprising:

a sole (10) having a top provided with a plurality of oblique conical locking grooves (11), said top of said sole (10) having a periphery provided with a plurality of waterproof ribs (15), said sole (10) having a periphery defining a plurality of locking recesses (13) each provided with a catch piece (131);

a vamp (20) having a bottom provided with a plurality of oblique conical locking blocks (21) each locked in said locking groove (11) of said sole (10), said bottom of said vamp (20) defining a plurality of waterproof slots (24) for receiving said waterproof ribs (15) of said sole (10) therein so that said vamp (20) is integrally formed with said sole (10);

a plurality of substantially U-shaped snapping pieces (22) each integrally secured in said bottom of said vamp (20) and each having two sides each provided with a hook (221); and a plurality of snapping knobs (12) each detachably secured on said snapping piece (22) and each including a press button (122) secured in said locking recess (13) and locked by said catch piece (131) of said sole (10), and a snap (121) pivotally mounted on said press button (122) and snapped on said hook (221) of said snapping piece (22).

2. The replaceable elastic air cushion shoe structure in accordance with claim 1, wherein said sole (10) defines a hollow chamber (16) therein, said hollow chamber having a side wall defining an opening (161) having a periphery defining a plurality of snap holes (165), a cover (162) removably mounted in said opening (161) and provided with a plurality of snap lugs (164) each detachably secured in said snap hole (165) of said opening (161), a magic strap (163) provided on said cover (162) and said periphery of said opening (161), a substantially U-shaped elastic steel piece (17) received in said hollow chamber (16) and having two side plates each defining a large retaining hole (172), a small retaining hole (173), and a connecting hole (174) connecting between said large retaining hole (172) and said small retaining hole (173), a plurality of elastic members (18) each mounted in said elastic steel piece (17) and each including an upper cap (181) and a lower cap (182), a top of said upper cap (181) and a bottom of said lower cap (182) each provided with a joint (184) and a connecting post (185), said joint (184) being fitted into said large retaining hole (172) and then shifted into said small retaining hole (173), said upper cap (181) and said lower cap (182) each provided with a hollow positioning post (186), and a spring (183) mounted between said upper cap (181) and said lower cap (182) and having two ends each secured on said positioning post (186).

3. The replaceable elastic air cushion shoe structure in accordance with claim 2, wherein said sole (10) has a surface defining a receiving recess (19), a channel (191) defined in said sole (10) and connected between said receiving recess (19) and said hollow chamber (16).

4. The replaceable elastic air cushion shoe structure in accordance with claim 2, further comprising a battery base (41) secured in said hollow chamber (16) of said sole (10), a battery (44) secured in said battery base (41), a light emitting member (40) mounted in said hollow chamber (16) of said sole (10) and electrically connected to said battery (44), said light emitting member (40) having a positive pole wire (42) and a negative pole wire (43) respectively extending through said hollow positioning post (186) of said upper cap (181) and said lower cap (182) so that said light emitting member (40) lights when said positive pole wire (42) and said negative pole wire (43) are moved by said positioning post (186) to electrically connect with each other.

* * * * *